United States Patent [19]

Macaulay

[11] Patent Number: 4,887,373

[45] Date of Patent: Dec. 19, 1989

[54] CALENDAR/EXECUTIVE PLANNER WITH REPOSITIONAL PERSONAL DIRECTORY SECTION

[76] Inventor: Norman MacCaulay, 66 Millwood Dr., Tonawanda, Erie, N.Y. 14150

[21] Appl. No.: 243,113

[22] Filed: Sep. 6, 1988

Related U.S. Application Data

[63] Continuation of Ser. No. 86,787, Aug. 19, 1987, abandoned.

[51] Int. Cl.[4] ..... B42D 1/10; B42F 1/00; B42F 5/00

[52] U.S. Cl. ..... 40/119; 281/38; 283/56

[58] Field of Search ..... 40/121, 40, 594, 119; 281/38, 42; 283/56

[56] References Cited

U.S. PATENT DOCUMENTS

| | | | |
|---|---|---|---|
| 1,487,586 | 3/1924 | MacNicol | 40/119 |
| 1,866,425 | 7/1932 | Shedd | 40/119 |
| 2,549,419 | 4/1951 | Callahan | 40/121 |
| 2,673,099 | 3/1954 | Hamilton | 40/119 |
| 3,138,508 | 6/1964 | Fairest | 40/594 |
| 3,324,823 | 6/1967 | Peters | 116/234 |
| 3,783,541 | 1/1974 | Bowerman | 40/121 |
| 4,043,063 | 8/1979 | Ambasz | 40/119 |
| 4,200,222 | 4/1980 | Feuer | 40/594 |
| 4,531,314 | 7/1985 | Parent et al. | 40/119 |
| 4,596,407 | 6/1986 | Suska | 281/38 |

*Primary Examiner*—Paul J. Hirsch

*Attorney, Agent, or Firm*—Cushman, Darby & Cushman

[57] ABSTRACT

A booklet having pages devoted to presentation of calendar days and pages for notational information mounted by repositionable adhesive.

5 Claims, 2 Drawing Sheets

11

| JANUARY | | | | | | 1987 |
|---|---|---|---|---|---|---|
| MONDAY | TUESDAY | WEDNESDAY | THURSDAY | FRIDAY | SAT | SUN |
| | | | 1 | 2 | 3 | 4 |
| 5 | 6 | 7 | 8 | 9 | 10 | 11 |
| 12 | 13 | 14 | 15 | 16 | 17 | 18 |
| 19 | 20 | 21 | 22 | 23 | 24 | 25 |
| 26 | 27 | 28 | 29 | 30 | 31 | |

CALENDAR/EXECUTIVE PLANNER WITH REPOSITIONAL PERSONAL DIRECTORY SECTION

This is a continuation of application Ser. No. 086,787 filed Aug. 19, 1987, now abandoned.

This invention pertains to a calendar/executive planner booklet having a repositional directory section.

Many busy people carry or have on their desks a booklet which sets forth a calendar showing the days of each month, perhaps with each month of a year provided. Usually space is provided under each day for engagements to be written down. The past booklets also have provided directory sections, where permanent information is recorded, such as names, addresses and telephone numbers. However, in the past at the end of the calendar period, the entire booklet had to be discarded, along with the directory section. This has meant that the directory sections had to be re-created for the next booklet.

GENERAL DESCRIPTION OF PRESENT INVENTION

According to the present invention a calendar/executive plannar type booklet is provided with one or more blank pages, preferably at the back, whereon directory sheets are mounted by repositional adhesive. In this way, when a booklet has been used to the end of the calendar period, the directory sheet or sheets may be moved to a similar location in the next booklet.

DISCUSSION OF PRIOR ART

Newman in U.S. Pat. No. 2,731,746 describes a calendar in which a directory or memorandum strip may be placed next to removable calendar sheets. Therefore, the same memorandum strip may be used with different calendar sheets. The disclosure does not involve booklets or directory sheets mounted by repositional adhesive. In Wade U.S. Pat. No. 871,310, a repositional adhesive is used, but only to take a marker tab from a sheet thereof (like a sheet of stamps) and position the tab on the calendar at a given date as a reminder. Hamburger et al, U.S. Pat. No. 696,098, is to a calendar in which tabs may be removed as the days pass. Schwarz, U.S. Pat. No. 823,702 is to the same effect.

DETAILED DESCRIPTION OF THE ILLUSTRATIVE EMBODIMENT OF THE INVENTION

Figures 1, 2:
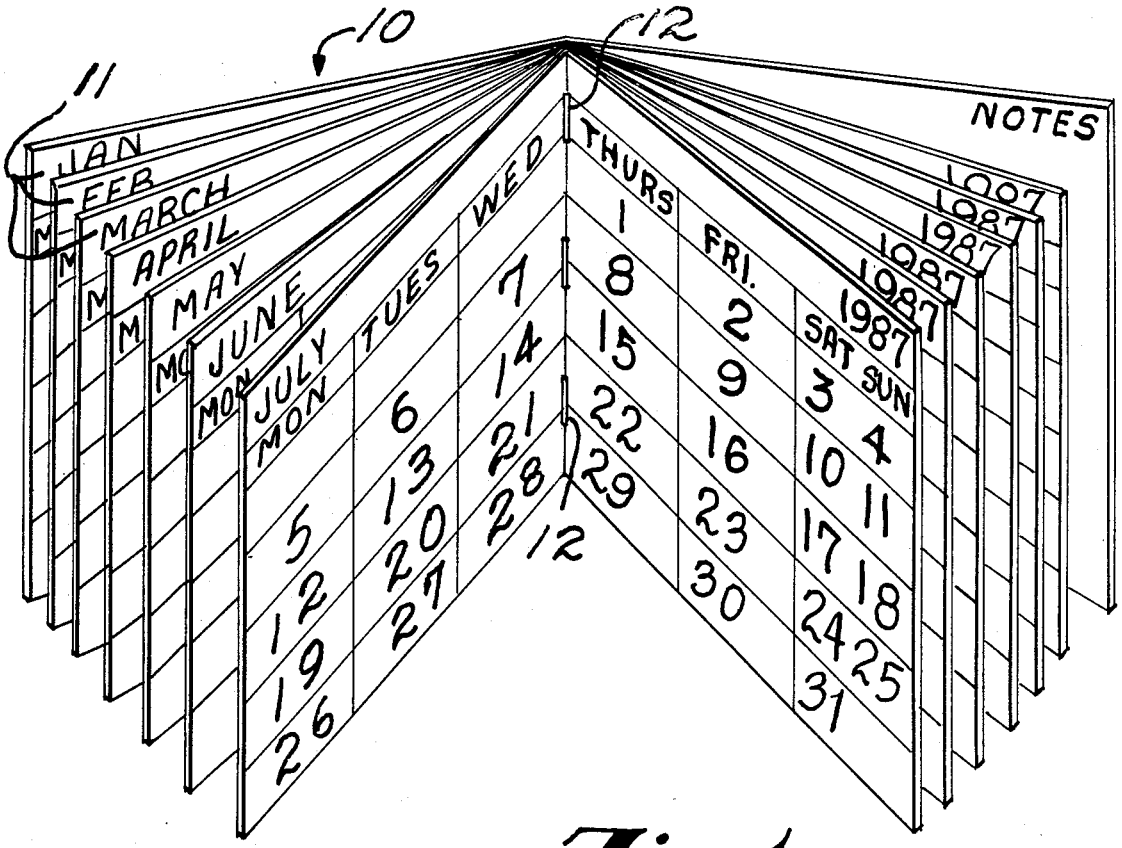
FIG. 1 is an isometric view of a booklet according to the invention in partially open form.
FIG. 2 is a view of the booklet laid open to January pages.

FIG. 1 shows an illustrative booklet 10 of the invention, with the pages spread from one another to show the arrangement of pages. The booklet 1 is made up of a stack of sheets 11 fastened together as by staples 12 along a central fold line to thereby provide pages for presenting calendar information and/or support for notational information sheets.

Figure 3:
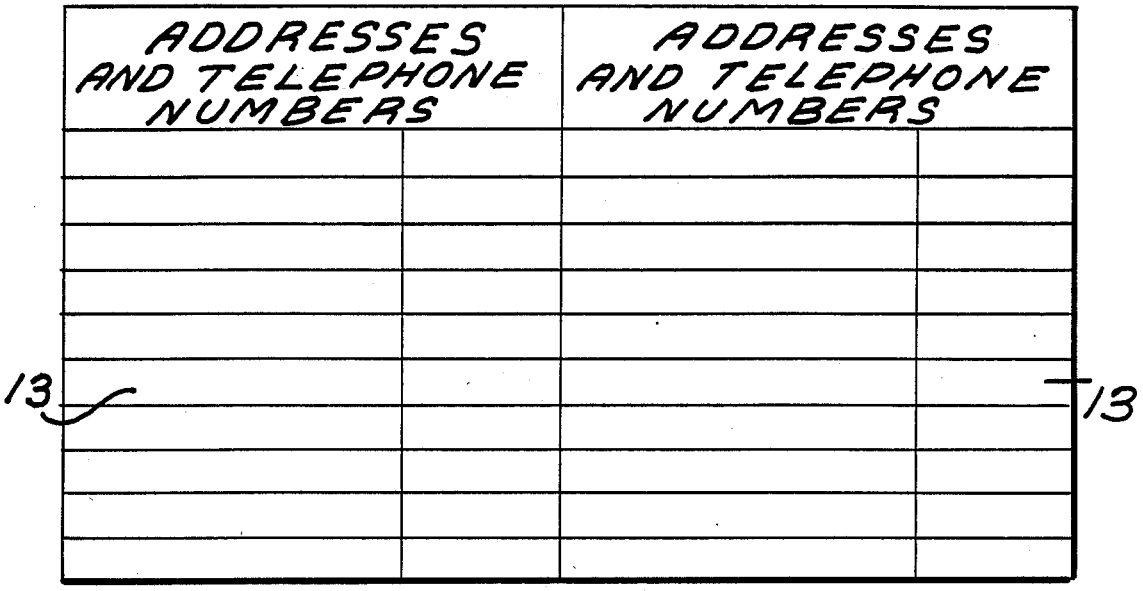
FIG. 3 is a view of two notational sheet pages with the booklet laid open thereto.
Figure 4:
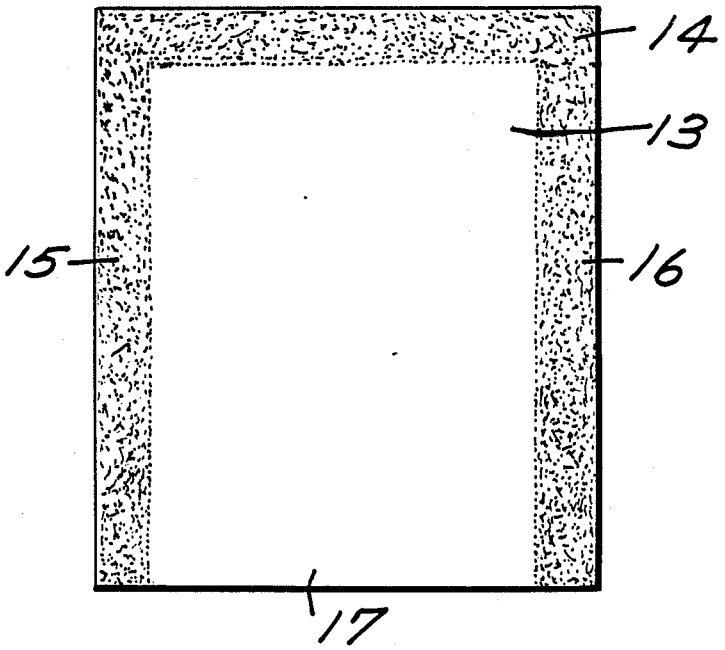
FIG. 4 is a view of the back side of one of the notational sheets shown in FIG. 3.

FIG. 2 shows the booklet laid open to present the days of the month of January. FIG. 3 shows the booklet 1 laid open to present two pages following the December pages. These pages have mounted thereon notational information sheets designated 13. Information such as addresses and telephone numbers may be placed on sheets 13. FIG. 4 shows the rear surface of a sheet 13, with strips of reuseable adhesive 14, 15 and 16 along three margins thereof. However, one margin 17 is not provided with adhesive. When sheet 13 is pressed against one of the pages of the booklet it will adhere thereto, except that one may use a fingernail, letter opener or the like to gain a hold on the sheet 13 to remove it from the page.

In use, the notational sheets 13 may be mounted in a calendar booklet 10 which is printed for a given year. However, at the end of that year, the notational sheets 13 easily may be removed and placed in a new booklet 10 printed for the new year. In this way the notational information need not be rewritten.

The foregoing embodiment is described only for illustrative purposes, and other embodiments of the invention will be apparent from the illustration. Therefore, the scope of the invention is to be determined from the appended claims.

What is claimed is:

1. A calendar and notational information booklet system for conveying notational information from one of such calendar and notational booklets to at least one of a succession of such calendar and notational booklets, said system comprising:

a booklet having a plurality of bound leaves preprinted with calendar indicia and at least one other leaf;

at least one notational information sheet having indicia on one side thereof for accepting notational information and having repositionable adhesive on the other side, said at least one notational information sheet mountable on said at least one other leaf of said booklet for accepting and retaining notational information thereon and removeable therefrom for transfer to the at least one other leaf of at least one of a succession of said booklets.

2. The calendar and notational information booklet system of claim 1, wherein said at least one other leaf of said booklet is rectangular and said at least one information notational sheet is rectangular to substantially overlay said at least one other leaf of said booklet.

3. The calendar and notational information booklet system of claim 2, wherein said repositionable adhesive on the other side of said at least one information notational sheet is located along a marginal edge thereof.

4. The calendar and notational information booklet system of claim 3, wherein said repositionable adhesive on the other side of said at least one information notational sheet is located along three of the four marginal edges of the at least one information notational sheet.

5. The calendar and notational information booklet system of claim 4, wherein the edges of said at least one information notational sheet are coterminous with those of said at least one other leaf of said booklet when said at least one information notational sheet is mounted thereon.

* * * * *